US005570652A

United States Patent [19]

Ferland

[11] Patent Number: 5,570,652

[45] Date of Patent: Nov. 5, 1996

[54] RODENT GUARD

[76] Inventor: Bret Ferland, 68 Rodney Ave., Islip Terrace, N.Y. 11752

[21] Appl. No.: 401,706

[22] Filed: Mar. 10, 1995

[51] Int. Cl.[6] ..... B63B 21/00

[52] U.S. Cl. ..... 114/221 R; 43/124

[58] Field of Search ..... 43/121, 124; 114/221 R

[56] References Cited

U.S. PATENT DOCUMENTS

| | | | |
|---|---|---|---|
| 1,160,634 | 11/1915 | Maynard | 114/221 R |
| 1,401,540 | 12/1921 | Konig | 114/221 R |
| 1,486,417 | 3/1924 | Cheely | 114/221 R |
| 1,641,081 | 8/1927 | Heymann | 114/221 R |
| 2,488,466 | 11/1949 | Carver | 114/221 R |
| 4,782,622 | 11/1988 | Roberts | 114/221 R |

FOREIGN PATENT DOCUMENTS

| | | | |
|---|---|---|---|
| 27957 | of 1911 | United Kingdom | 114/221 R |

*Primary Examiner*—J. Elpel

*Attorney, Agent, or Firm*—Bauer & Schaffer

[57] ABSTRACT

A pest guard comprises a flat disk mounted on a cylindrical sleeve which is fixed against linear movement on a support member by a pair of clamps. The sleeve is provided with a longitudinal slot permitting it to be placed over the support member. The clamps are each formed by two halves and adapted to be fitted over a respective ends of the sleeve so that the clamps permit rotational movement of the sleeve but inhibit longitudinal movement of the sleeve about the cable. The disk is provided with a central opening such that it is permitted to rotate about the sleeve. The disk is also provided with a radial, curved slit which resists opening and which maintains the disk flat through extended use.

9 Claims, 1 Drawing Sheet

RODENT GUARD

FIELD OF THE INVENTION

The present invention relates generally to improvements in pest guards and, more particularly, to a barrier against rodents adapted to be mounted on support members such as cables, guy wires or the like.

BACKGROUND OF THE INVENTION

It is known in the prior art to mount guards on supports such as cables, guy wires and even hawsers of vessels to prevent rodents from travelling along supports and reaching the structure, such as a building or a ship, to which these supports are attached. This precaution has been taken particularly with the view of preventing the spread of damage, as well as diseases which are often carried by these rodents.

Conventional guards have been provided in which a barrier in the form of a disk includes an opening through which the support (cable, guy wire, etc.) is passed, and the disk is supported by means of a connecting flange or block separate from or integral with the disk which fixes the disk transversely to the support. A disadvantage with conventional pest guards of this kind is that, by virtue of the disk being fixed to the support, rodents are permitted to balance on the several parts of the guards and successfully pass from one side of the guard to the other.

Another disadvantage with conventional pest guards of the type described is that often the disks do not remain transversely positioned upon the support or flat during extended use, in which case it is possible for the rodents to jump over the guard. Still other conventional guards are not closely fitted over the support, permitting rodents to pass the disk or barrier by finding small apertures at or about the support through which they can pass without attempting to jump over the guard.

Yet another disadvantage with conventional pest guards is that they are complex in construction and contain many parts, thus resulting in guards which require long periods of time to assemble and are expensive to manufacture.

SUMMARY OF THE INVENTION

It is an object of the present invention to provide a pest guard which effectively prevents rodents from passing from one side of the guard to the other.

Another object of the present invention is to provide a pest guard which can be closely fitted to and remain positioned transversely on a support.

It is a further object of the present invention to provide a guard with a minimum number of parts which can be assembled in a short period of time.

It is yet another object of the present invention to provide a guard which is simple and practical in construction, strong and reliable in use, small and compact in structure and relatively inexpensive to manufacture.

Briefly stated, the present invention comprises a pest guard comprising tubular sleeves for encircling the support, such as a wire or cable, clamp means for securing the sleeve to the wire in a fixed and stationary manner and prevented from lengthwise movement along the cable, and a barrier member adapted to freely encircle the tubular means. The barrier member is provided with a slit extending from its center to its periphery and is held on the sleeve by a pair of brackets spaced to allow the disk to rotate and have slight longitudinal movement.

In a preferred embodiment, the tubular sleeve comprises a cylindrical sleeve having opposite ends and a longitudinal slit permitting the sleeve to be fitted over the support member. The clamp means comprises a pair of clamps, each adapted to be fitted over a respective end of the sleeve so as clamp the sleeve to the supporting member. The barrier comprises a disk having a circular opening, and the slit in the barrier is in a shape to allow the disk to resist opening and remain flat through extended use and may be provided with fastening means.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF PREFERRED EMBODIMENT

Figure 1:
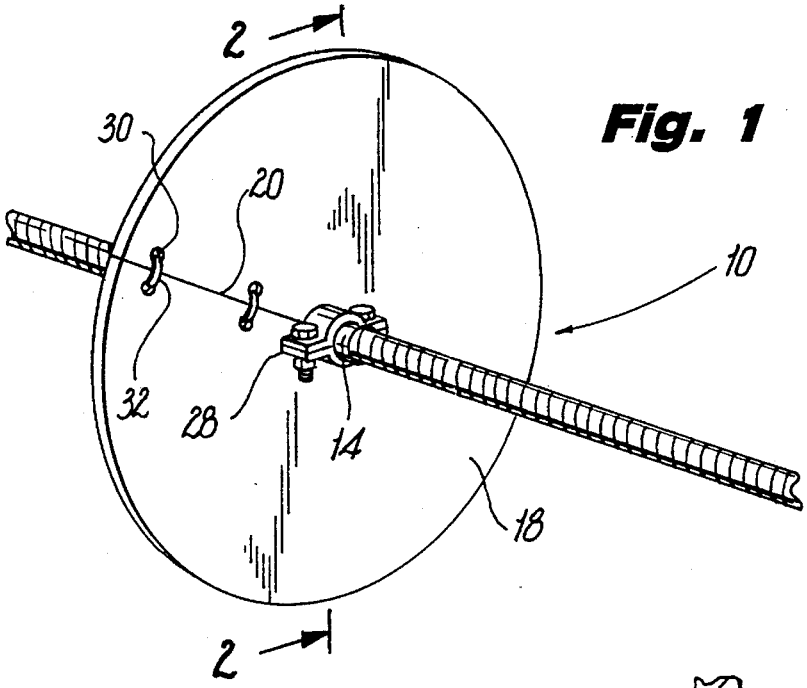
FIG. 1 is a perspective view of pest guard in assembled condition according to the present invention.
Figure 2:
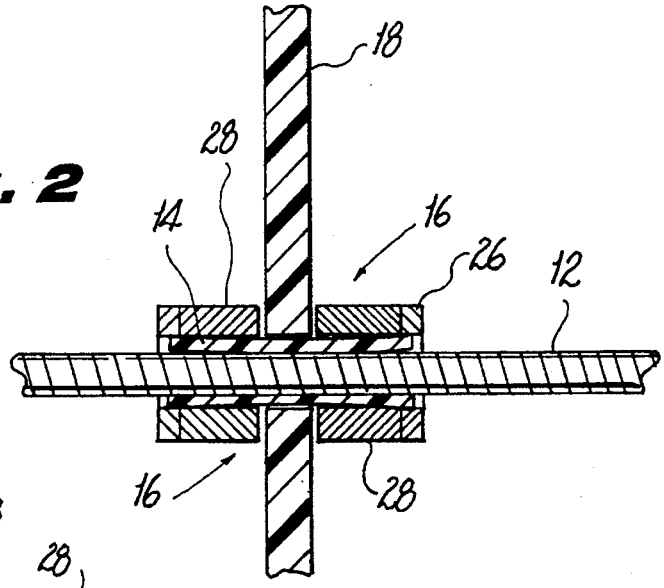
FIG. 2 is a sectional view diametrically through the guard and wire.
Figure 3:
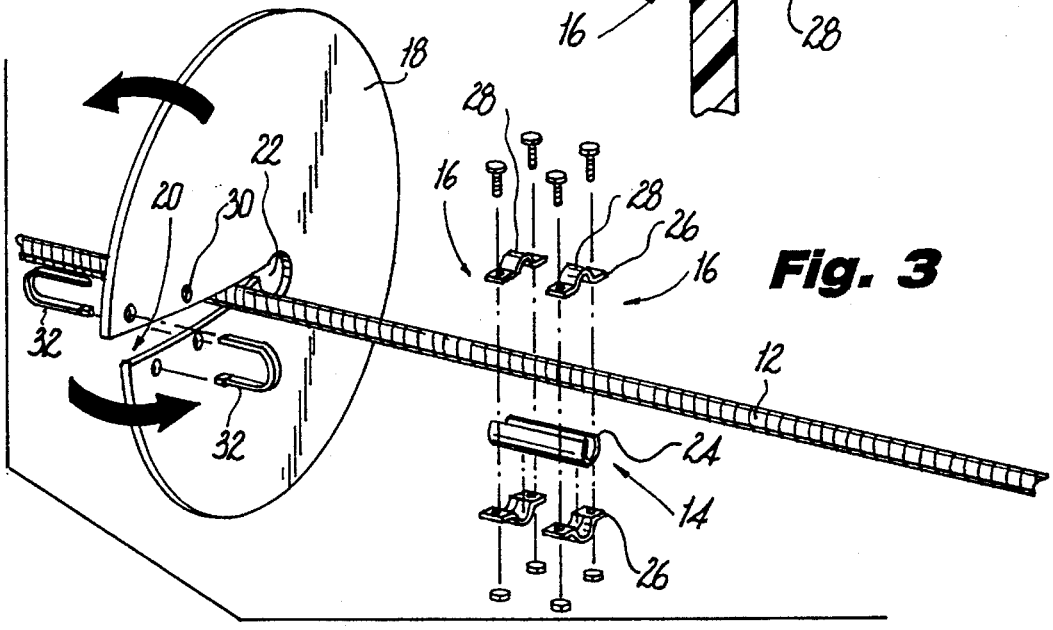
FIG. 3 is an enclosed perpendicular view of a clamp means.

Referring now to the drawings in detail, wherein like numerals are used to indicate like elements throughout, there is shown in FIGS. 1–3 a preferred embodiment of a pest guard generally designated 10. The guard 10 is adapted for mounting on a wire, cable or the like, here referred to as a support 12 such as, for example, the electrical lead wire from street to house to prevent pests, particularly rodents, from travelling along such wire and reaching the house to which the wire is attached.

As shown in FIG. 1, the guard 10 comprises a short tube-like sleeve 14 adapted to encircle the wire 12 and secured to the wire 12 by a pair of clamps 16. The clamps 16 fixedly secure the sleeve against both rotation and lengthwise movement relative to the support wire 12. A barrier member in the form of a disk 18 is located about and encircles the sleeve 14. The barrier disk has a radial slit 20 extending from its center to its peripheral edge and a central hole 22 adapted so as to hold the barrier disk in a plane at all times substantially transverse to the tubular sleeve 14.

According to a preferred embodiment of the present invention, the tubular sleeve 14 comprises a round cylinder having opposite ends and provided with a longitudinal slot 24 permitting it to be spread so as to enable it to be placed over the wire 12. The sleeve 14 preferably has smooth inner and outer surfaces, and an inner diameter only slightly greater than the diameter of the wire 12. Preferably, the sleeve 14 is injection molded in one piece from a flexible plastic material. It will be appreciated that the material of the sleeve 14 is such as to be sufficiently rigid for maintaining its cylindrical form, while providing for sufficient resiliency to allow it to be placed over the cable 12 by means of the longitudinal slot 24.

The sleeve 14 is held in place by the clamps 16, which are adapted to be fitted over the sleeve at the respective ends of the sleeve 14. As shown in FIG. 2, each clamp 16 is formed of a pair of C-shaped clamp halves 26 secured at their laterally extending wings by bolts, screws or the like. Preferably, the clamps 16 are arranged slightly inward from the respective ends of the sleeve 14.

Preferably, the clamp halves 24 are each molded in one piece in a single mold from a rigid inert plastic. Of course, depending on the support, the tubular sleeve and the clamps may be made of aluminum or other metal.

The barrier disk 18 according to the present embodiment comprises a flat, planar, circular plate having its central opening 22 of a diameter slightly larger than the outer diameter of the sleeve 14, so that when mounted over the sleeve the disk will be permitted to rotate about the sleeve and shift between the secured clamps 16. The radial slit 20 in the barrier or disk 18 permits the disk to be fitted over the sleeve 14. The slit 20 is preferably a straight radius or even a curved, generally radially slit which resists opening and which maintains the disk flat through extended use. The slit may be secured against opening by providing means fastening the two sides of the slit together. Preferably, the disk 18 is provided with a series of holes 30, of ⅛ inch diameter, spaced about 1 to 1½ inches apart on either side of the radial slit 20 and parallel to the slit 20. Plastic ties bands 32 or rachet type self-locking ties are inserted into one or more the holes 30 so as to secure the slit against opening when the device is placed in use.

It is understood by those skilled in the art that the disk 18 should be of sufficient diameter to prevent even large rodents from climbing or jumping over the same. Preferably, the disk 18 is made using the same fabrication method and material as for the sleeve 14.

It will be appreciated those skilled in the art that, by virtue of the free rotational movement of the sleeve 14 and disk 18 with respect to the wire 12 and clamps 16, rodents and the like will not have a rigid, fixed structure on which they can balance to successfully pass from one side of the disk to the other. Repeated baning against the barrier will not deform the disk or cause the slit 20 to open. Another advantageous feature of the pest guard 10 of the present invention is that the sleeve, clamps and disk can be closely fitted to the structure, such as a cable, so as to prevent rodents from passing through the disk or barrier or by finding small apertures at or about the support through which they can pass without attempting to jump over the guard.

Further advantages of the pest guard of the present invention are that it requires only a minimum number of parts which can be assembled in a short period of time, that it is simple and practical in construction, that it is strong and reliable in use, and that it is small and compact in structure and relatively inexpensive to manufacture.

From the foregoing description, it can be seen that the present invention comprises an improved pest guard adapted to be mounted on cables, guy wires and the like. It will be appreciated by those skilled in the art, that changes could be made to the embodiment described in the foregoing description without departing from the broad inventive concept thereof. It is understood, therefore, that this invention is not limited to the particular embodiment disclosed, but is intended to cover all modifications which are within the scope and spirit of the invention as defined in the appended claims.

What is claimed is:

1. A rodent guard comprising:

a cylindrical sleeve having opposite ends and a longitudinal slit extending between said ends for permitting said sleeve to be placed over a wire, or cable; clamp means for mounting said said sleeve against axial movement along the wire, or cable and a barrier member comprising a disk having a circular opening through its center of a diameter greater than the diameter of said sleeve to permit free relative rotation of said disk with respect to said sleeve said disk having a radial slit extending from said circular opening to the periphery of said disk permitting mounting of said barrier on said sleeve.

2. A rodent guard as claimed in claim 1, wherein said clamp means comprises a pair of clamps, each clamp being adapted to fix said sleeve securely to the wire or cable.

3. A rodent guard as claimed in claim 2, wherein said barrier member, said sleeve and said clamps are made of a plastic material.

4. A rodent guard as claimed in claim 2, wherein each clamp comprises a pair of sections and means for securing said sections to one another and to the wire or cable.

5. A rodent guard as claimed in claim 2, wherein each clamp is provided with an inner surface having a circular recess for receiving a respective end of said sleeve so as to prevent relative rotation and inhibit relative longitudinal movement of said sleeve with respect to the wire or cable.

6. A rodent guard as claimed in claim 1, wherein said radial slit extends from said circular opening to the peripheral edge of said disk.

7. A rodent guard as claimed in claim 6, including means for securing the disk about the slit to prevent said slit from opening.

8. A rodent guard according to claim 7, wherein said securing means comprises paired holes on the respective sides of said slit and the means securable in said paired holes.

9. A rodent guard as claimed in claim 6, wherein said disk is made of a plastic material.

* * * * *